United States Patent [19]

Robertson

[11] 4,175,710

[45] Nov. 27, 1979

[54] HIGH PERFORMANCE SHREDDER APPARATUS

[76] Inventor: Steven J. Robertson, 209 Oak St., Cocoa, Fla. 32922

[21] Appl. No.: 823,649

[22] Filed: Aug. 11, 1977

[51] Int. Cl.[2] ..... B02C 18/22

[52] U.S. Cl. ..... 241/55; 241/73; 241/89.2; 241/285 A

[58] Field of Search ..... 241/51, 55, 73, 89, 241/89.2, 191, 197, 285 A, 285 B, 300

[56] References Cited

U.S. PATENT DOCUMENTS

| | | | |
|---|---|---|---|
| 1,470,177 | 10/1923 | McNaughton | 241/89.2 |
| 1,575,853 | 3/1926 | MacGregor | 241/55 |
| 1,945,054 | 1/1934 | MacGregor et al. | 241/51 |
| 2,068,383 | 1/1937 | Lindgren | 241/89.2 |
| 2,314,689 | 3/1943 | Craig | 241/191 |
| 2,494,107 | 1/1950 | Ryan | 241/51 |
| 3,642,214 | 2/1972 | Blackwell, Jr. | 241/191 |

*Primary Examiner*—Howard N. Goldberg
*Attorney, Agent, or Firm*—Rose & Edell

[57] ABSTRACT

The shredder apparatus has all high wear regions of the stationary parts protected by readily replaceable liners. A funnel fed arrangement into the shredder chamber prevents jams of material being fed to machine and build up of foil and dirt, etc., which can also cause jams. Wind vane bolts are recessed into the rotor and wind vanes are located on the lower wear side thereof and cooperating bolts are located on the low wear or protected side of the vane. A replaceable dummy wear liner is provided under the shredder screen to protect the frame and is readily replaceable and removable by lifting from its craddle. The shred heads are comprised of two parts, a yoke and a replaceable head portion to extend life of each head and provide ease of replacement.

9 Claims, 15 Drawing Figures

FIG.3
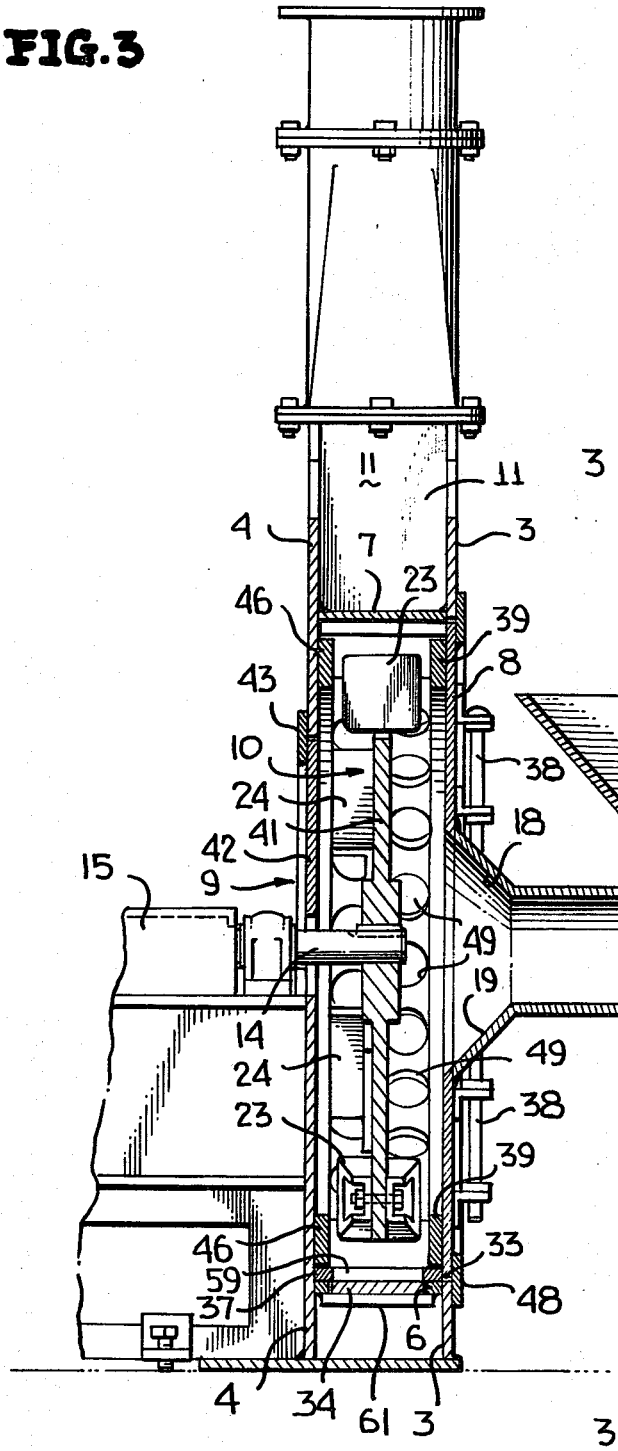
FIG.7
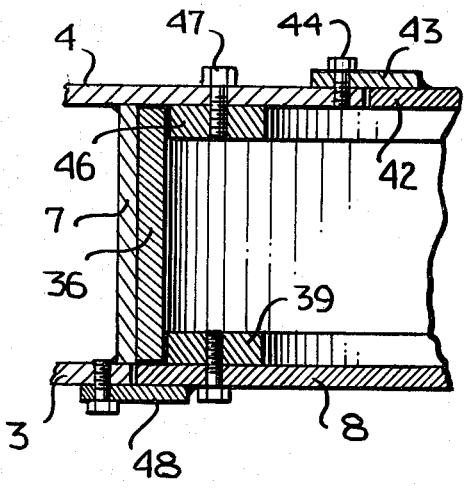
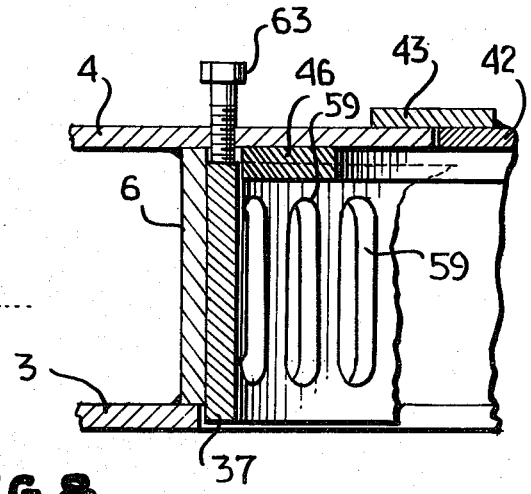
FIG.8

FIG.5
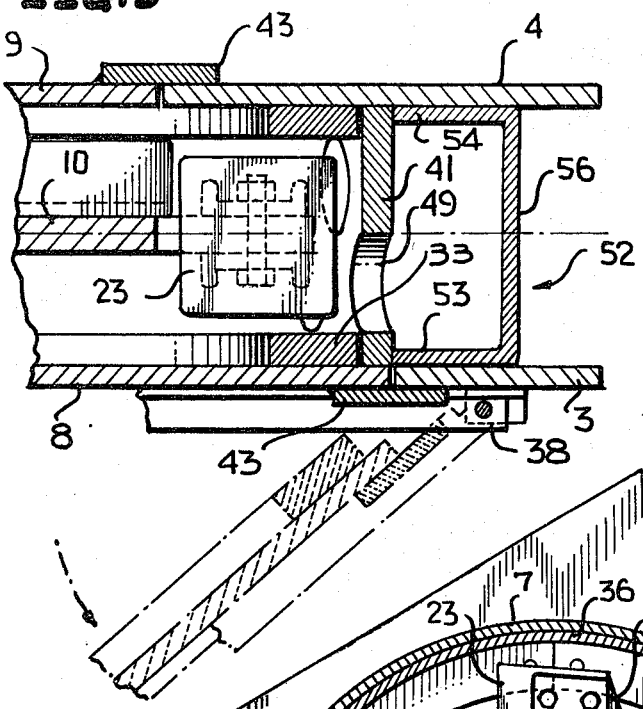
FIG.4
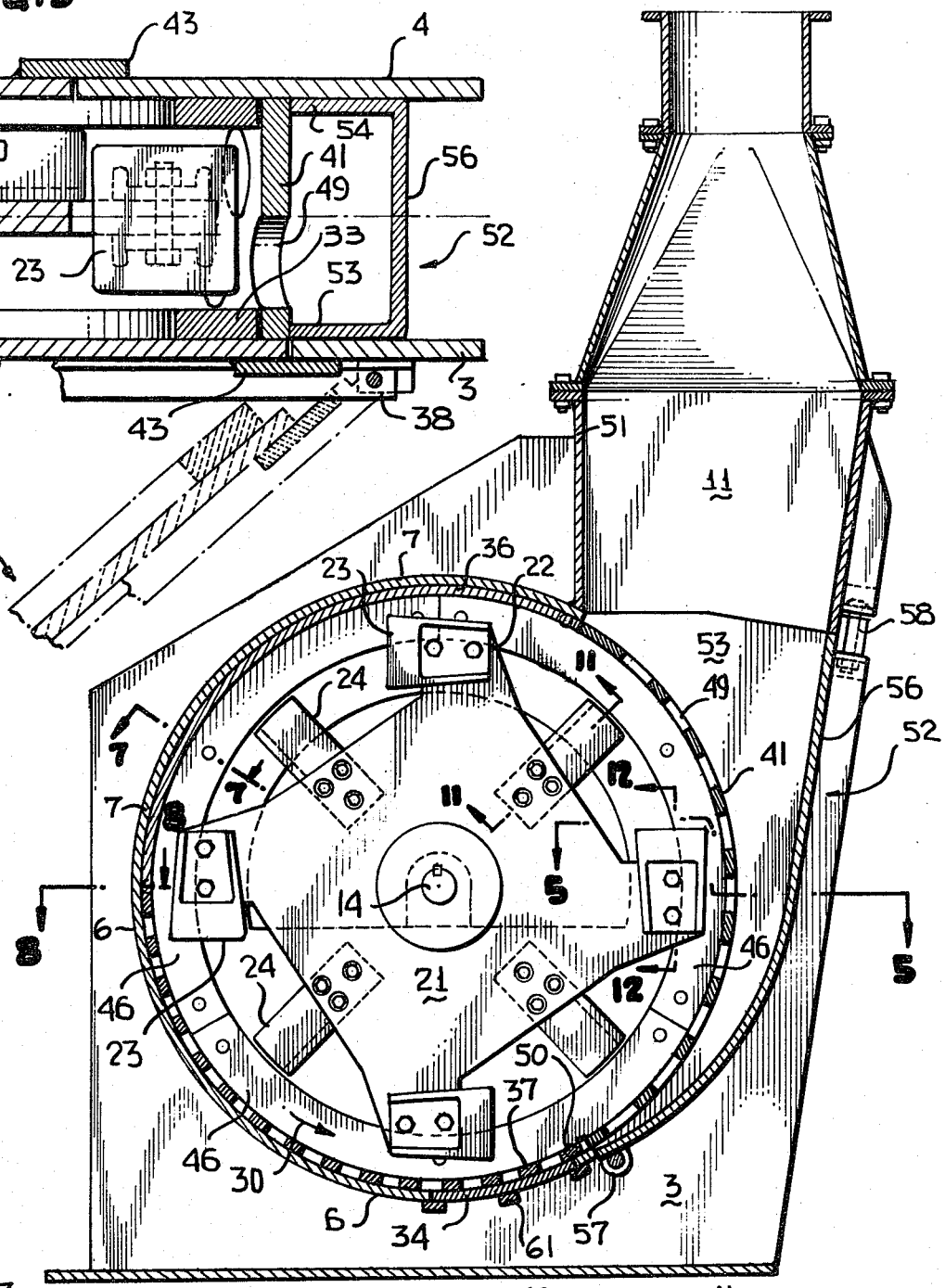
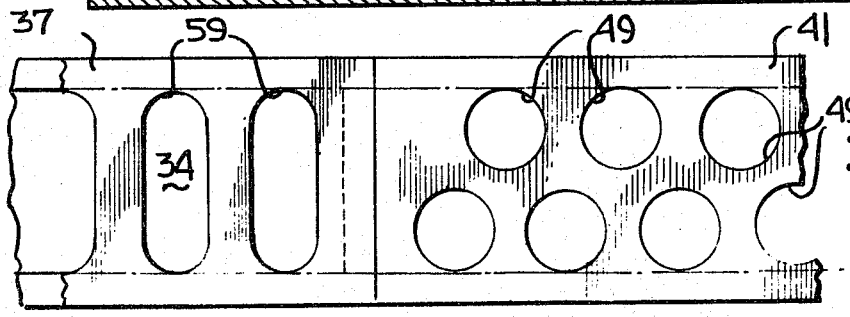
FIG.6

FIG.9
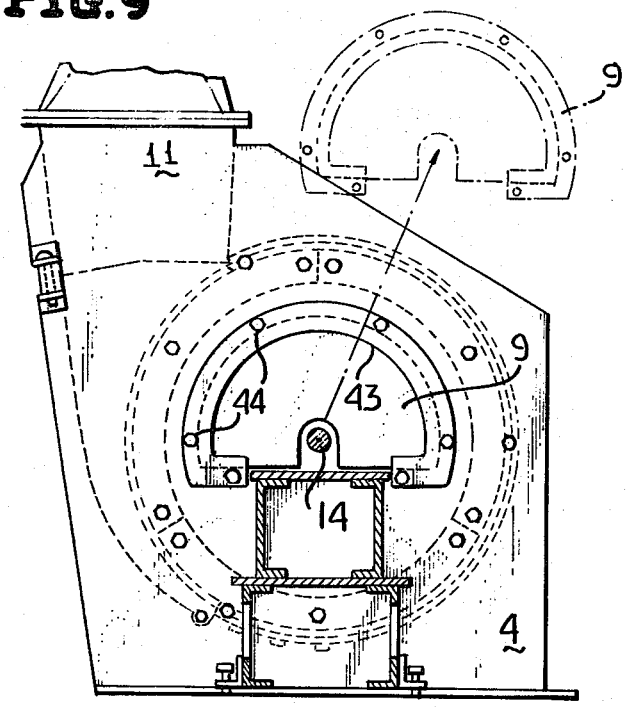
FIG.11
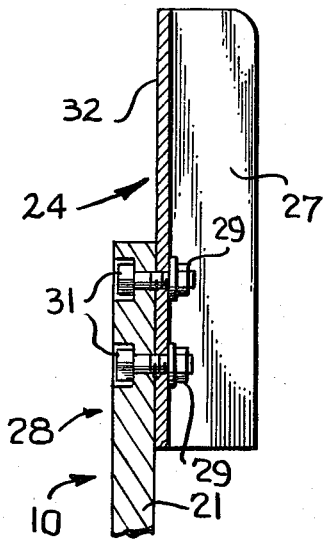
FIG.12
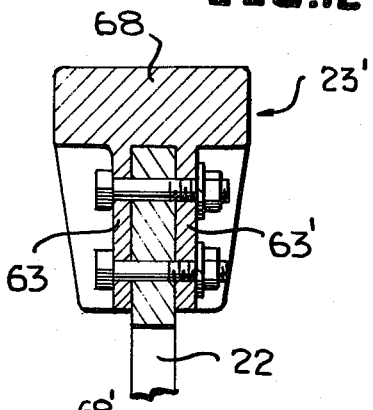
FIG.10
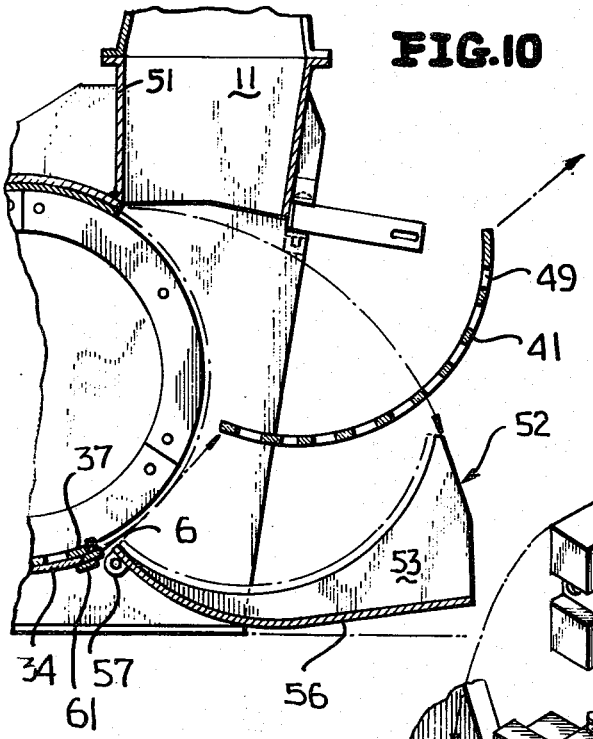
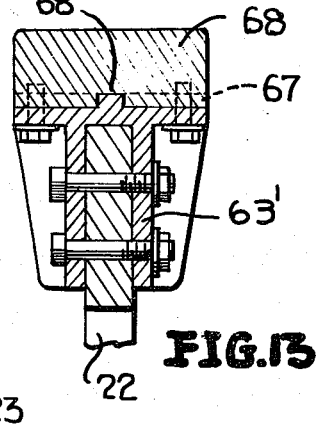
FIG.13
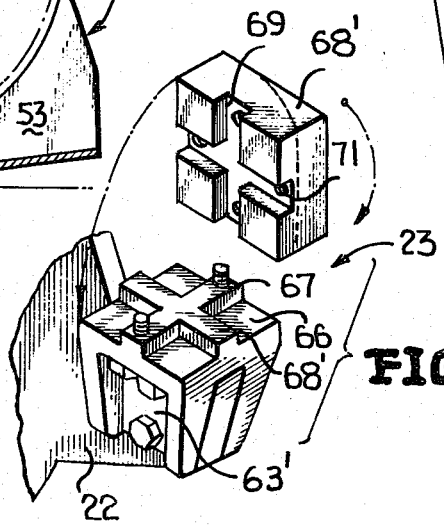
FIG.14

HIGH PERFORMANCE SHREDDER APPARATUS

BACKGROUND OF THE INVENTION

The present invention relates to shredder apparatus and more particularly to high production rate industrial metal shredding devices.

The closest prior art known to inventor is the 100 H.P. shredder manufactured by Miller Manufacturing Company, Turlock, Calif. The Miller machine has many problems and a relatively short life. Further, it is quite difficult to service and it is equally difficult to maintain high production rates with the apparatus.

No provisions have been made to reduce wear of or extend life of major wear elements or to protect or strengthen vulnerable parts such as nuts or bolt heads of parts directly engaged in the shredding operation. For instance nuts that hold on vanes in the rotor are completely exposed and located on the high wear side of the rotor. The shredder liner lies against the main frame of the device so that the main frame is rapidly worn and this region of the frame must be regularly cut out with a torch and a new section welded in. Further the Miller unit employs a square recessed region terminating the input chute resulting in a build up of foil and other deposits which adversely effect operation of the machine. The apparatus further makes no provision for removal of worn out liners either in the form of ready access thereto or mechanism for loosening lines which are virtually "welded" in by deposits of fines and mud, etc. In consequence the machine has low production rates and very high cost of maintenance and repair.

THE INVENTION

The shredder of the present invention provides two side walls having therebetween a circular end wall defining a shredder chamber having a shredder rotor therein. Rapid and ready access to all parts of the shredding chamber is provided through large access doors in each side wall of the chamber. The chamber is provided with side wear liners spaced inwardly of the circular wall of the shredder chamber to define an annular space between the side wear liners on each side wall of the chamber and the circular wall of the chamber. Various liners, such as transfer and apertured shredder and exit liners extend between the sidewalls and have their outer edge regions located in such annuli. The provision of the annuli permit liners to be retained in place without bolts and this in conjunction with push out studs to break worn liners loose, greatly facilitates maintenance of the machine.

A removable dummy liner is located under the standard shredder liner to protect the frame of the apparatus and may be removed concurrently with the shredder liner.

An additional feature of the invention is the provision of a funnel shaped entry into the chamber for feeding in material. The apparatus is often used for processing cans and if the side wall is tight against the rotor at the point of entry cans introduced enclosure do not have enough room to enter and jam the entrance. The funnel shape permits the cans to enter skewed and thus are crushed and pulled in by the rotor. Further, such an arrangement does not provide a horizontal surface for build-up of foil, mud, etc., which can also produce problems in the feed region.

In consequence of the ready access to the shredder chamber and the use of a replaceable dummy liner and replaceable shred head the apparatus can be completely refurbished including rotor and bearings in less than one and one half hours and the basic machine will last tens of millions of pounds of shredded material with proper servicing.

It is an object of the present invention to provide a shredder apparatus having a long life at high rates of production, i.e. at rates depending upon desired density of processed aluminum of from 1800 to 3000 pounds per hour with a 100 H.P. motor.

Another object of the present invention is to provide a shredder apparatus having a shredder liner having a readily replaceable dummy liner to protect high wear surfaces of the apparatus adjacent the shredder screen.

Still another object of the present invention is to provide a high production, long life shredder apparatus, having a funnel shaped feed into a shredder chamber whereby to avoid jamming of material at the entry to the chamber.

Yet another object of the present invention is to locate various particularly vulnerable parts of a high performance shredder apparatus at protected locations and/or low wear locations whereby to increase life thereof.

It is another object of the present location to provide a high performance shredder apparatus having readily replaceable shred heads and simple means for removing replaceable liners.

DESCRIPTION OF THE DRAWINGS

FIG. 3 is a view in section taken along line 3—3 of FIG. 1;

FIG. 4 is a view in section taken along line 4—4 of FIG. 2;

FIG. 5 is a view in section taken along line 5—5 of FIG. 4;

FIG. 6 is a plain view of the shredder and exit screens;

FIG. 7 is a view in section taken along line 7—7 of FIG. 4;

FIG. 8 is a view in section taken along line 8—8 of FIG. 4;

FIG. 9 is a view in section taken along line 9—9 of FIG. 2;

FIG. 10 is a partial front view in elevation illustrative the exit screen and side door in the open position.

FIG. 11 is a partial side view in section of the wind vanes of the apparatus;

FIG. 12 is a view in section taken along line 12—12 of FIG. 4;

FIG. 13 is an elevation in section of a modified form of shred head;

FIG. 14 is an exploded view of the shred head of FIG. 13; and

Figures 1, 2, 15:
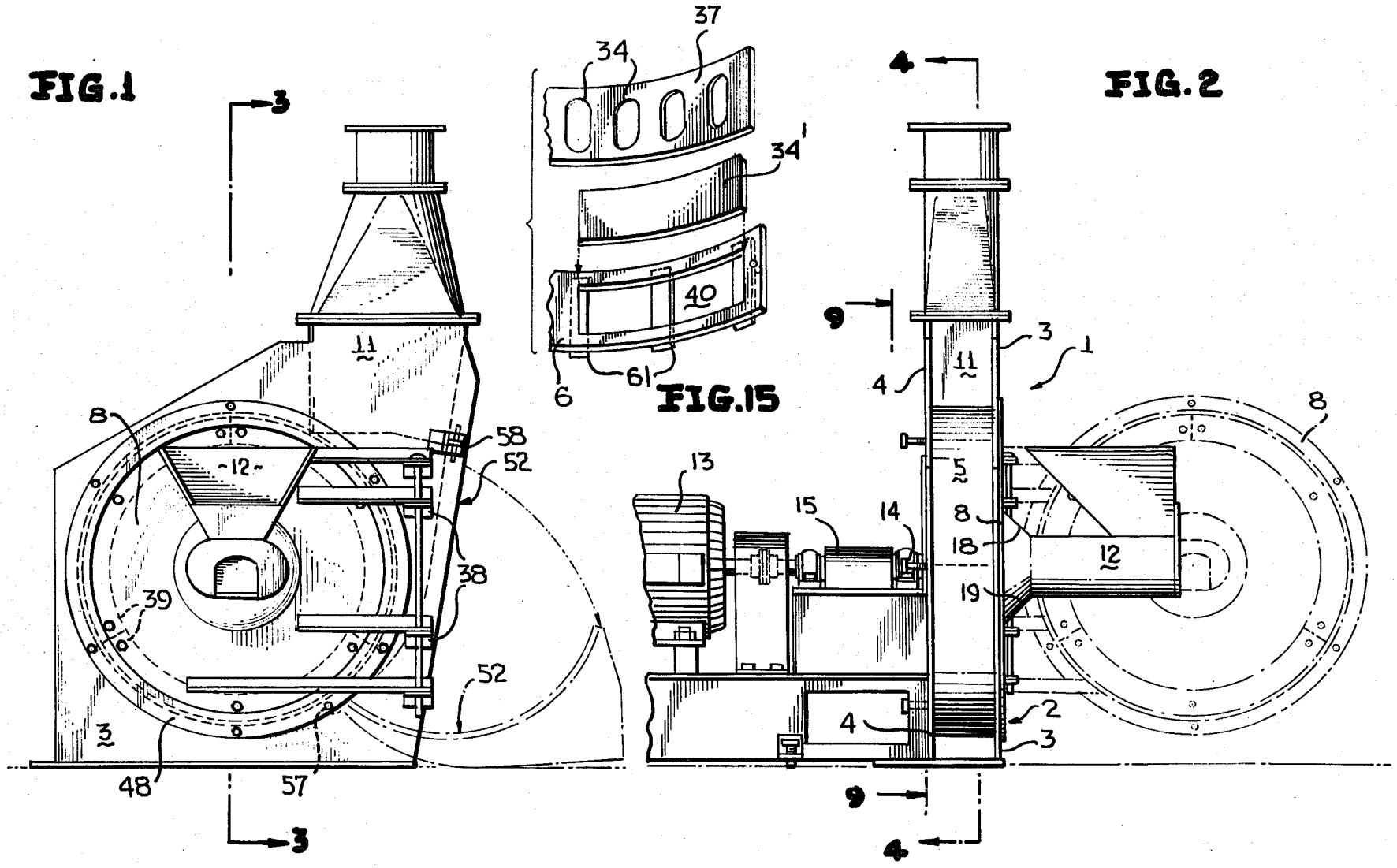
FIG. 1 is a front view in elevation of the present apparatus.
FIG. 2 is a side view in elevation of the present apparatus.
FIG. 15 is a partial view in section of a modification of the shredder screen and dummy liner.

Referring now specifically to FIGS. 1–4, a can shredder 1 includes a hollow, relatively thin housing 2 comprising two vertically upstanding and spaced walls (frame members) 3 and 4 having arcuate members 6 and 7 welded therebetween to define a chamber 5 having access doors 8 and 9. A chute 11 exits from the hollow chamber 5 (see FIG. 2) and provides the exit passage for the material processed by the shredder.

A delivery chute 12 provides an entry into the hollow shredder 5. A shredder rotor, generally designated by reference numeral 10, is driven by a high speed, high torque motor 13 (50 to 125 H.P.) that drives a shaft 14 which enters into the hollow chamber 5 through a pillow block 15 from the side opposite the delivery chute 12 and is attached to the shredder rotor.

The delivery chute 12 comprises a hopper 16 into which material is loaded and a horizontal passage 17 that terminates at the chamber 5 in outwardly sloping top and bottom walls 18 and 19. Due to the close tolerance between the shredder rotor 10 and the side walls of the chamber 5 required to provide effective shredding action, cans approaching the chamber 5 lengthwise could not pass into the chamber and would jam the feed chute. The sloping walls 18 and 19 permit the cans to enter the chamber at an angle and be crushed between the rotor 10 and the adjacent wall 3 and be pulled into the chamber and due to the slope minimize problems of build up of foil, trash, mud, etc., in the entryway.

Referring now specifically to FIG. 4, the shredder rotor 10 comprises a main body 21, generally square and having four outwardly extending arms 22 each having a shred head 23 secured thereto. The arms are located at 90° relative to one another about the periphery of the rotor 10 to nominally maintain balance of the rotating mechanism.

The shred heads have their outer peripheries located closely adjacent the peripheral walls of the chamber 5 so as to crush and tear objects located between the heads and walls as more fully explained subsequently.

The rotor 10 is also provided with four wind vanes 24 spaced equidistant between each pair of arms 22. The vane is an L-shaped member having a base 32, see FIG. 11, bolted against the rotor 10 and a leg 27 extending perpendicular to the plane of rotor 10 and located at the leading edge of the vane relative to the direction of rotation of the rotor 10 as indicated by arrows 30. The wind vanes create windage to pump shredded material out of the chute 11 and concurrently suck in material in the hopper 12. The rotor is rotated such that the shred head 23 have a linear velocity of approximately 20,000 feet per second and the wind force created is sufficient to accomplish its intended purpose.

Inevitably the vanes 24 and adjacent areas contact material in the chamber 5 and are abraded thereby. The vanes 24 are each bolted to the rotor 10 by three nut and bolt arrangements 28. In order to prevent destruction of the nut and bolt arrangements, the nuts, reference numeral 29, are protected by the leg 27 of the vane. Heads 31 of the bolts are countersunk in the rotor and are located on the low wear side of rotor 10 and thus are adequately protected from damage. In this manner vanes do not break loose and cause material damage to the mechanism and also the nuts and heads of bolts are not materially deformed so that they may readily be disengaged when it becomes necessary to change vanes.

The chamber 5, as previously indicated, is defined by arcuate members 6 and 7 welded between vertical walls; frame members, 3 and 4. The frame member 3 has a large diameter opening 33 and the member 7 is welded between the members 3 and 4 at the edge of the opening 33 extending in FIG. 4 from about 1 o'clock, counterclockwise to about 9 o'clock. The arcuate member 6 extends from about 9 o'clock counterclockwise to about 5 o'clock; being bifurcated (see FIG. 3) in the region between 6 o'clock and 5 o'clock to provide a slotted region in which a first replaceable arcuate wear liner 34 may be disposed for purposes to be defined subsequently. The liner 34 is held in position by cross ribs 61 welded between the two legs of frame member 6.

If substantial wear is not confined to the 5 to 6 o'clock region then the frame member 6 may be located outside of the edge of the opening 33 such that the inner surface of the member 6 is in the arcuate plane of the outer arcuate surface of the member 7. In such a case the arcuate liner 34, lies over the entire arcuate length of the member 6 and has an inner diameter about the same as the inner diameter of member 7 such that a continuous inner surface is established. A transfer liner 36 overlies the member 7 and a ripper liner 37 overlies the liner 34.

The opening 33 is closed by the door 8 supported on hinges 38 secured to frame member 3. The door 8 is provided with three arcuate side wear liners 39 each extending for about 120° around the interior of the door 8 and having an outer diameter slightly less than the inner diameter of the liners 36 and 37 and an exit screen 41 to be described subsequently. The liners 39 extend into the chamber 5 about one inch so as to overlap the adjacent edges of the liners 36, 37 and screen 41 by about the same dimension since the liners substantially extend from vertical frame member to vertical frame member.

The door 9 constitutes a plate 42 that is approximately a half circle (see FIG. 9) having a diameter somewhat less than the smaller diameter of the side wear liners 46. Further, the plate 42 has a recess formed at the center of its diameter to accept an upward projection of the wall 4 which carries a bearing through which shaft 14 passes. Thus the shaft is journaled in the main frame member 4. The plate 42 is provided about its entire outer periphery with a plate or series of plates 43 which are welded to the plate 42 and overlap adjacent regions of the wall 4. The plate 43 is bolted to the wall 4 at various locations designated by the reference numeral 44, the plate 42 closing an opening in the plate 4 provided to permit access to the back of the chamber 5 for servicing the apparatus.

The wall 4 is provided interiorly of the chamber 5 with flat arcuate side wear liners 46 each extending about 120° about the wall 4 in a plane parallel to the rotor 10. The liners 46 have the same inner and outer diameters as flat arcuate side wear liners 39.

Referring specifically to FIG. 7, the side wear liners 39 and 46 are secured to the door 8 and wall 4, respectively, by bolts 47 that are threaded into the liners and terminates at the interior surface thereof. In this manner the bolts were away at the same rates as their associated liners and do not interfere with the operation of the device or lose their effectiveness as would be the case with a conventional nut and bolt arrangement. Further threads of the bolt do not become fouled and make withdrawal of the bolts difficult.

It should be noted that the door 8 is, when closed, bolted in place. Specifically the door 8 is provided with a peripheral flange 48 welded to the door and overlying an adjacent region of the vertical wall 3. The flange 48 is bolted to wall 3 to hold the door 8 closed.

The exit screen 41 extends between liners 36 and 37 and has formed therein a plurality of holes 49 providing passage of material in chamber 5 into the exit chute 6. The chute 11 is defined by side members 3 and 4, a vertical wall 51 welded between walls 3 and 4 and commencing at the clockwise edge of member 7 in FIG. 4 and a side door 52. The door 52, shown in its open position in FIG. 10 and also illustrated in FIG. 5, has two side walls and an outer wall 56 the latter forming the outer wall of the chute 6 when the door 52 is closed. The walls 53 and 54 have long edge surfaces having a diameter equal to the inner diameter of the liners 7 and 34 and curve outwardly from the wall 56 providing an appearance quite similar to one of an operative jaw of a staple puller.

The door 52 is hinged between walls 3 and 4 adjacent the counterclockwise edge of frame member 6, hinge 57, and the edges of walls 53 and 54 follow the curvature of the liners. The exit screen 41 is trapped in the region located between the edges of the walls 53 and 54 and the side wear liners 39 and 46 respectively. The door 52 is latched closed by latch 58.

The ripper liner 37 is provided with a plurality of holes, as in the exit liner, or with a plurality of slots 59 as illustrated in FIG. 6.

The purposes of the various liners are as follows: The transfer liner 36 provides a region for crushing and/or tearing the material to be treated between the liner and the shred heads 23. This material may be newly introduced material or material that is still to large to pass through openings 49 into the chute 6.

The material next passes between the heads 23 and shredder screen 37. The material is pressed into the openings 59 in the screen and ripped and torn along the edges of the holes. The material is then presented to exit screen 41 and that which has been sufficiently reduced in size passes through screen 41 to the exit chute 6.

The liner 34 is employed to provide a replaceable wear surface under the shredder liner 37. It is believed apparent that the crushing and tearing action occurring at the liner 37 has a destructive effect on the material underlying openings 59 as on the material defining the openings. The liner 34 thus is used to provide a readily replaceable surface under the liner 37.

The liner 37 has been illustrated as having openings throughout its arcuate length. This arrangement is not always necessary and openings may be provided over a lesser part of its length. In such a case and reference is made to FIG. 15 of the accompanying drawings, the liner 37 has openings only over the region illustrated. In the region that does not have openings, the wear liner 34 is not required. Therefore, the wall member 6 is located in arcuate alignment with member 7 and has a rectangular section 40 under the openings in the shredder liner 37, removed. A replaceable wear liner 34' is located in region 40 and is supported on cross bars 61; the edge of member 6 being protected by the side wear liners.

It will be noted that space for instance, between the side wear lines 39 and 46 and the arcuate member 7 define two annular regions into which the edges of the various liners 34, 36, 37 and 41 extend and are fully protected from abrading action of the materials being crushed and shredded. As a result the life and effect of the apertured liners 37 and 41 are greatly increased. The apertures may extend across the entire region between side wear liners 39 and 46 thus providing maximum operating area.

The side wear liners 39 and 46 not only serve to protect the liners 34, 36, 37 and 41 but provide for extreme ease of insertion and subsequent replacement thereof. The liners are simply fitted into place between the liners 46 and 39 and frame members as applicable. The liners form complete circles of maximum diameter and thus readily support each other in place until the door 8 is closed at which time complete support of the liners is provided entirely about their longitudinal edges. No bolts or other holding or clamping devices are required except a stud 50 located between screen 41 and liner 37 to prevent rotation of the liners from their desired position as illustrated.

In the event the liners become bound in the apparatus for any reason, such as build up of compacted fines and mud at the interface between the liners and adjacent frame members, the arrangement of FIG. 8 is employed. Studs 63 are threaded into and through frame member 4 and about one or more of the removable liners. Pressure from the stud 63 when rotated is enough to break the liners loose.

The shred heads 23 may take the form of the head illustrated in FIG. 12 wherein each head was a yoke 63' that spans its associated arm 22 and is bolted thereto. A head wears on a maximum along the edge adjacent the outer liners and when sufficiently worn along such an edge may be removed and rotated 180° so as to extend the life of the head.

To further extend the life of the head 23, the arrangement of FIGS. 13 and 14 is provided. The head 23 comprises a yoke member 63' including a flat upper surface 66, as viewed in FIG. 14. The surface 66 has two upward projections 67 and 68', generally square in cross section disposed at right angles to one another and extending from edge to edge of surface 66 across the center thereof. A replaceable head member 68 having a working surface generally extensive with surface 66 has grooves 69 and 71 formed in an undersurface thereof which are the female equivalents of projections 67 and 68', respectively. The head member 68 may be bolted to yoke 63' in any one of four different orientations and thus greatly increases the life of each head and reduces costs not only because of incurred life but also because only a small part of the head must be replaced.

While I have described and illustrated one specific embodiment of my invention, it will be clear that variations of the details of construction which are specifically illustrated and described may be resorted to without departing from the true spirit and scope of the invention as defined in the appended claims.

I claim:

1. A shredder apparatus comprising a housing having side walls and a circumferential end wall defining a hollow chamber, a rotor located in said chamber, a plurality of shred heads located on said rotor, a replaceable ripper screen comprising an arcuate member having a plurality of openings therethrough, said ripper screen being located along the path of movement of said shred heads and spaced outwardly therefrom by a distance such that objects located between said shred heads and said ripper screen are crushed and torn, a liner lying adjacent and generally in contact with said ripper screen along the side thereof remote from said shred heads, a plurality of side wear liners located along said side walls and spaced inwardly from said end wall to define grooves along each side of said chamber, said liners and said ripper screen having edges located in and retained in said grooves, and a door providing access to said hollow chamber, said door having a surface defining one of said side walls whereby upon opening said door said ripper screen may be removed.

2. A shredder apparatus according to claim 1 comprising a plurality of wind vanes located and spaced about said rotor, each said vane having a base member contacting said rotor and an outwardly extending arm at the leading edges, relative to the direction of rotation of said rotor, of said base member, a plurality of bolts, said rotor having holes through which said bolts pass and having a recessed region around said hole to receive heads of said bolts, nuts for engaging said bolts, said bolts passing through said base member of said vane and being engaged by said nuts.

3. A shredder apparatus according to claim 1 wherein said shred heads each comprise a yoke defined by spaced legs, each said yokes straddling a different region of said rotor and bolted thereto, a head portion for each said yoke, and means for removable securing said heads each to a different one of said yokes in four different 90° related positions.

4. A shredder apparatus according to claim 1 further comprising a plurality of threaded studs, a plurality of threaded holes in, and extending through said side wall remote from said door in alignment with solid regions of said liner and said shredder screen one said stud threaded in each of said holes.

5. A shredder apparatus according to claim 1 wherein said shred heads each comprise a yoke defined by spaced legs, each said yokes stradling a different region of said rotor and being symmetrical relative to said rotor, each said yoke having a base member disposed against said rotor and wind screens extending from both leading and trailing edges of said base member, and means disposed between said wind vanes for removably securing said yokes to said rotor.

6. A shredder apparatus according to claim 5 wherein said shred head further comprises a removable head member, and means for securing said head member to said shred head in at least four different 90° rotated positions.

7. A shredder apparatus comprising a housing having side walls and a circumferential end wall defining a hollow chamber, a rotor located in said chamber, a plurality of shred heads and a plurality of wind vanes disposed about said rotor, a generally horizontal input chute extending through one of said side walls, said input chute having upper and lower walls flaring outwardly in the direction of approach into said chamber, a door providing access to said hollow chamber and defining one of said side walls, a removable ripper screen located along the path of movement of said shred heads and extending between said side walls, a plurality of side wear liners secured to said side walls and defining an annulus on each side wall having its outer circumferential surface spaced from said end wall by a distance at least equal to the thickness of said ripper screen whereby said ripper screen is removably secured in position upon closing of said door.

8. A shredder apparatus according to claim 7 further comprising an apertured ripper screen spaced outwardly from and located parallel to the path of travel of said shred heads, a liner underlying said ripper screen, and a means for retaining said screen and said liner in position during operation of said machine.

9. A shredder apparatus according to claim 7 further comprising a wear liner lying against said ripper screen on the side thereof opposite said heads, said distance approximating the combined thickness of said ripper screen and said wear liner adjacent said side walls.

* * * * *